United States Patent [19]

Ooyabu

[11] Patent Number: 4,990,881

[45] Date of Patent: Feb. 5, 1991

[54] IGNITION COIL WITH PERMANENT MAGNET

[75] Inventor: Shinji Ooyabu, Obu, Japan

[73] Assignee: Nippondenso Co., Ltd., Kariya, Japan

[21] Appl. No.: 364,065

[22] Filed: Jun. 9, 1989

[30] Foreign Application Priority Data

Jul. 28, 1988 [JP] Japan ..... 63-186814
Sep. 27, 1988 [JP] Japan ..... 63-241582

[51] Int. Cl.[5] ..... H01F 17/06; H01F 27/24

[52] U.S. Cl. ..... 336/110; 123/634; 336/107; 336/178; 336/216

[58] Field of Search ..... 336/110, 178, 212, 165, 336/233, 234, 216, 96, 107; 123/634

[56] References Cited

U.S. PATENT DOCUMENTS 2,844,786 7/1958 Van Urk et al. ..... 336/110 X
4,546,753 10/1985 Pierrit ..... 336/110 X
4,658,799 4/1987 Kusaka et al. ..... 336/234 X

FOREIGN PATENT DOCUMENTS 7924989 11/1980 Fed. Rep. of Germany .
3336773 5/1985 Fed. Rep. of Germany .
3428763 2/1986 Fed. Rep. of Germany .
4849425 10/1946 Japan .
59-167006 9/1984 Japan .

*Primary Examiner*—Thomas J. Kozma
*Attorney, Agent, or Firm*—Cushman, Darby & Cushman

[57] ABSTRACT

In an ignition coil in which an air gap portion is provided at a portion of an iron core forming a closed magnetic circuit, which includes an exciting part iron core having a primary coil and a secondary coil wound therearound, and a strong permanent magnet is inserted in the air gap portion, the closed magnetic circuit is constructed to have the iron core and permanent magnet provided with respective suitable shapes, dimensions, properties, etc. so as to make most of the characteristics of the strong permanent magnet, thereby drastically reducing the size and weight of the ignition coil. Further, a concrete improvement of the construction of the closed magnetic circuit of the ignition coil is attained to assure excellent magnetoelectric conversion performance of the ignition coil.

8 Claims, 11 Drawing Sheets

IGNITION COIL WITH PERMANENT MAGNET

BACKGROUND OF THE INVENTION

The present invention relates to improvements of an ignition coil, particularly for use in internal combustion engines for vehicles.

Conventionally, literatures such as JU-A-4849425, West German UM Registration No. 7924989, JP-A-59167006 and U.S. Pat. No. 4,546,753, for example, have presented a proposal wherein a permanent magnet is inserted in an air-gap portion of an iron core to increase energy stored in an electromagnetic coil such as an ignition coil. However, none of the literatures has disclosed an established technique relating to the structure of an ignition coil, as to what shape, dimension, etc. the iron core and permanent magnet in a magnetic circuit should have in order for the ignition coil to operate efficiently. In the past, even when a permanent magnet was used in an ignition coil put into practical use, a resulting ignition coil did not show any remarkable practical improvement in the performance and compactness as compared with an ignition coil using no permanent magnet. On the other hand, in recent years, a strong permanent magnet material containing such an element as samarium (Sm), neodymium (Nd), etc. has been developed and put into mass production, thus making it possible to expect expanded practical applications thereof. A permanent magnet made of such a material can have a strong magnetizing force capable of causing an iron core of an ignition coil to be saturated sufficiently when the permanent magnet is used to be inserted in a air-gap portion of the iron core of the ignition coil. Under the circumstances, permanent magnet materials having a property suitable for the application to ignition coils have become easily available.

SUMMARY OF THE INVENTION

An object of this invention is to provide an ignition coil which can sufficiently take advantage of the excellent property of the aforementioned strong permanent magnet material by forming a magnetic circuit so configured as to include an iron core and a permanent magnet having a suitable shape, dimension, etc., thereby reducing the size and weight of the ignition coil drastically.

In order to attain the aforesaid object, the present invention provides an ignition coil comprising an iron core and a permanent magnet having a dimensional relation obtained on the basis of the fact and data resulting from various researches and experiments, which relation satisfies the following conditions:

$$0.6\ \text{mm} < l_m < 1.8\ \text{mm}$$

$$2 < S_M/S_F < 6$$

$$1.5 < S_G/S_F < 4.5$$

where $l_M$ is the thickness of the permanent magnet, $S_M$ is the cross-sectional area of the permanent magnet, $S_F$ is the cross-sectional area of an exciting part of the iron core, and $S_G$ is the cross-sectional area of a permanent magnet supporting portion of the iron core.

In the ignition coil of this invention, a permanent magnet is inserted in an air-gap portion formed at a portion of the iron core which includes an exciting part iron core around which a primary coil and a secondary coil are wound and forms a closed magnetic circuit.

Prior to the energization of the primary coil, the iron core is magnetized by a magnetizing force of the permanent magnet to reach a state of a maximum working magnetic flux density in the negative direction which is opposite to the direction of magnetization to be caused by the energization of the primary coil. Then, when putting the ignition coil into practical operation, an exciting current is made to flow through the primary coil to generate a magnetizing force opposite to the magnetizing force of the permanent magnet, thereby causing the iron core to be magnetized to reach a state of a maximum working magnetic flux density in the positive direction. In this state, when the primary coil exciting current is interrupted at a timing of ignition, the secondary coil can utilize an effective interlinkage flux which is twice as much as an effective interlinkage flux obtained in a conventional ignition coil which uses no permanent magnet but uses only the energization of the primary coil so as to magnetize the iron core to reach a state of a maximum working magnetic flux density in the positive direction. Accordingly, with the ignition coil of this invention, the volume of an ignition coil necessary for the ignition coil to generate a given level of sparking energy can be reduced drastically as compared with the volume of a conventional ignition coil.

Further, another object of this invention is to improve the construction of a magnetic circuit of an ignition coil according to the present invention so that the ignition coil having a permanent magnet inserted in an air-gap portion formed at a portion of an iron core including an exciting part iron core to form a closed magnetic circuit may surely develop its excellent magnetoelectric conversion performance.

BRIEF DESCRIPTION OF THE DRAWINGS

FIGS. 15(A) and (B) are explanatory diagrams for explaining a process of assembling an E–I type iron core which is used to prevent air gaps from appearing at junction portions of the iron core of the ignition coil, wherein FIG. 15(A) shows a conventional E–I type iron core.

DESCRIPTION OF THE PREFERRED EMBODIMENTS

Figure 1:
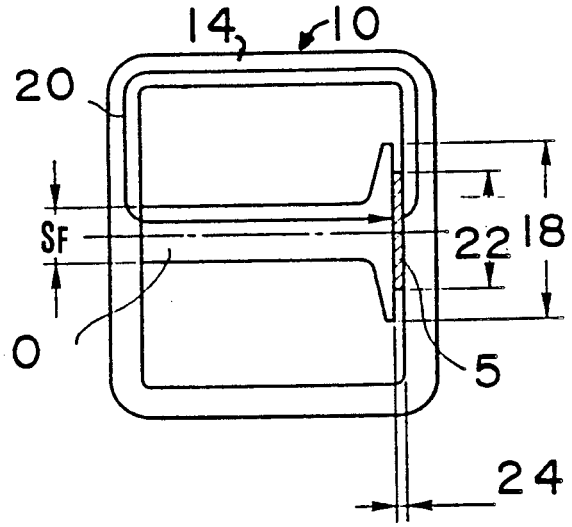
FIG. 1 is a schematic drawing showing a fundamental magnetic circuit for the iron core, which has a permanent magnet inserted at a portion thereof, of the ignition coil of an embodiment of the present invention.

FIG. 1 schematically shows a structure of a magnetic circuit of an iron core for use in an ignition coil of an embodiment of this invention having a permanent magnet 5 inserted therein, where a so-called shell-type iron core 10 is used in which a T-shaped exciting part iron core 12 is surrounded by a □-shaped outer part iron core 14 to form a closed magnetic circuit. Thus, the ignition coil of this invention has the magnetic circuit shown in FIG. 1, wherein reference numeral 16 indicates the area constituting the cross-sectional area $S_F$ of the exciting part iron core 12 through which magnetic flux $\phi$ passes, reference numeral 18 indicates the area constituting the cross-sectional area $S_G$ of a permanent magnet supporting portion of the iron core 12, reference numeral 20 represents a mean magnetic path length reference $l_f$, numeral 22 indicates the area constituting, $l_f$ the cross-sectional area $S_M$ of the permanent magnet and reference numeral 24 represents the thickness $l_f$ the permanent magnet 5.

Figure 2:
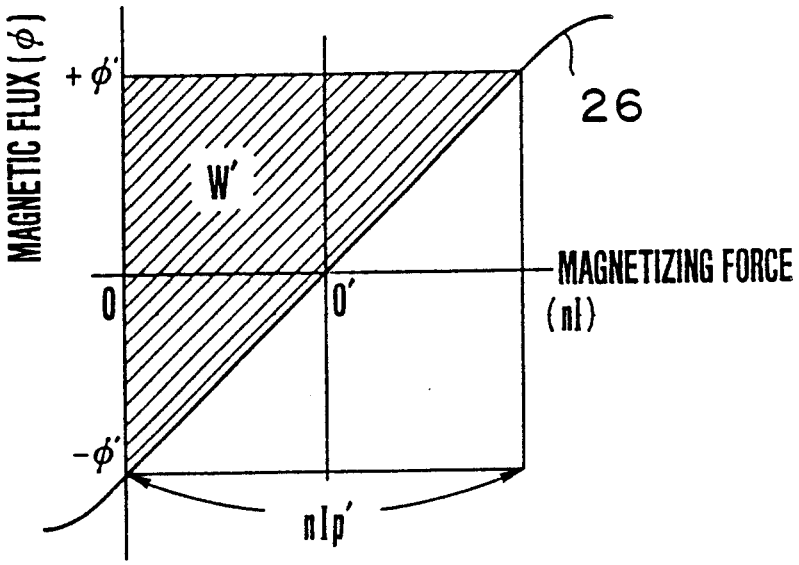
FIG. 2 is a performance characteristic diagram for illustrating the fundamental magnetic performance of the ignition coil of this invention.
Figure 3:
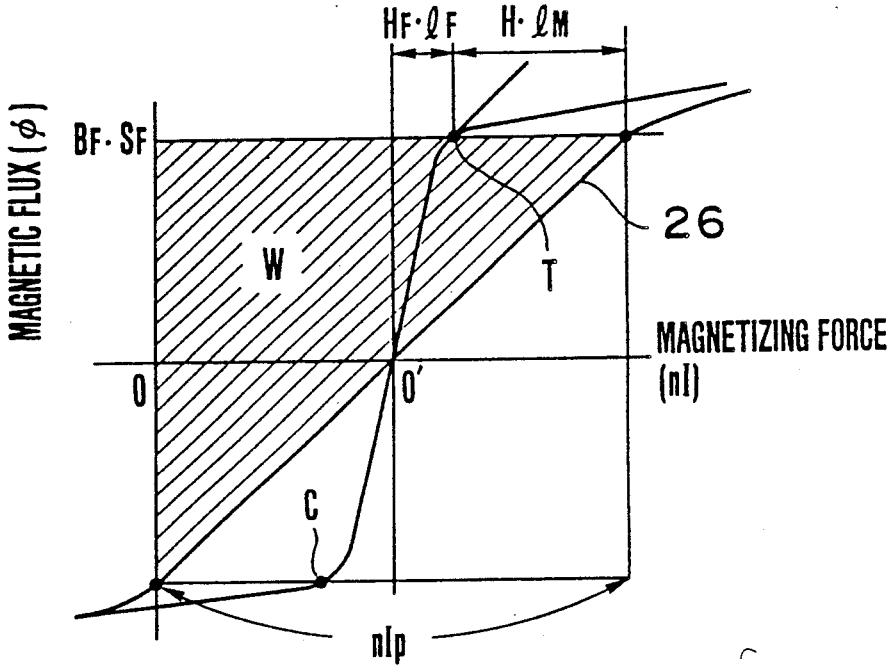
FIG. 3 is a magnetic performance characteristic diagram for illustrating the magnetic performance of the ignition coil of a preferred embodiment of this invention.

FIG. 2 is a performance characteristic diagram showing the fundamental characteristics of magnetic performance o the ignition coil according to this invention. Referring to FIG. 2, when a primary coil is wound by n turns on the exciting part iron core 2 of the ignition coil of this invention and an exciting current $I_p'$ is passed through the primary coil such that a magnetic flux $+\phi$ is generated in the exciting part iron core 12 in the direction opposite to the direction of magnetization of the permanent magnet 5 which generates a magnetic flux $-\angle$ in the negative direction, energy stored in the primary coil is represented by a hatched area W' in FIG. 2 and amounts to $W' = \frac{1}{2}\cdot(2\phi')\cdot nI_p' = \phi'\cdot nI_p'$. Reference numeral 26 represents the magnetization curve of the primary coil. As shown in FIG. 3, in order to maximize the energy W' stored in the primary coil of the ignition coil having the inserted permanent magnet 5, a magnetizing force of the permanent magnet 5 must magnetize the iron core to a point C near the saturation point of the negative flux of the iron core 12 in the negative flux region. This negative flux region is depicted in the lower left of FIG. 3 which shows the characteristics of magnetic performance of a preferred embodiment o the ignition coil according to this invention.

Figure 4:
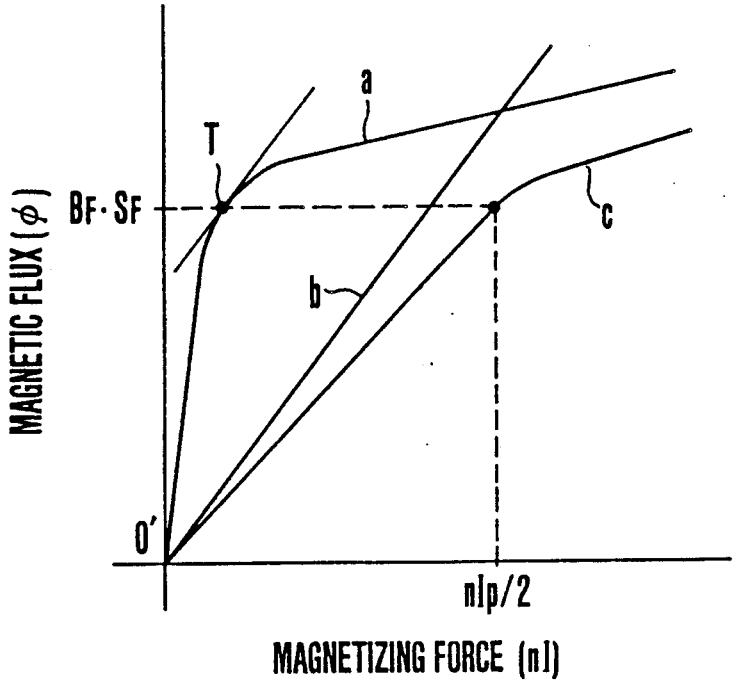
FIG. 4 is an explanatory diagram for explaining a process of determining a suitable value for the maximum working magnetic flux density of the iron core in the positive flux region of the magnetic performance characteristics shown in FIG. 3.

On the other hand, FIG. 4 shows the positive flux region in FIG. 3 which is used to explain the manner of determining a suitable value of the maximum working magnetic flux density of the iron core which corresponds to the maximum value of the exciting current conducted through the primary coil of the ignition coil of this invention.

In FIG. 4, a curve a represents a magnetization curve of the iron core 12, a straight line b represents a magnetization curve of the permanent magnet 5, and a curve c represents a magnetization curve of the primary coil, whereby the magnetizing force shown by the curve c is the sum of a magnetizing force shown by the curve a and that shown by the straight line b. Referring to FIG. 4, a suitable value of the maximum working magnetic flux density $B_F$ is given by a value of the magnetic flux density of the iron core 14 at a point T on

10 the curve a, the tangent line of the curve a at the point T being parallel to the straight line b. Accordingly, the maximum working magnetic flux is indicated by $B_F \cdot S_F$.

On the other hand, since the gradient of the magnetization curve of the primary coil is determined by permeability $\mu$ of the permanent magnet 5, it is of significance that a permanent magnet material having a value of $\mu$ which is as close to one as possible should be selected in order to increase energy stored in the primary coil, the energy being represented by a hatched area W in FIG. 3.

In connection with the ignition coil of the invention, the relation between the thickness $l_M$ of the permanent magnet 5 and the cross-sectional area ratio $S_G/S_F$ will now be examined.

When considering the positive flux region in FIG. 3, the magnetizing force $nI_p/2$ produced by an exciting current flowing through the primary coil is the sum of a magnetizing force $H_F \cdot l_F$ of the iron core 12 at the maximum working magnetic flux point (where $H_F$ is a magnetic field in the iron core) and a magnetizing force $H \cdot l_M$ across the air-gap portion including the permanent magnet at the maximum working magnetic flux point (where H is a magnetic field generated in the airgap portion). Thus, the above-mentioned relation is expressed by $$\frac{nI_p}{2} = H_F \cdot l_F + H \cdot l_M$$

Then, the following equation results.

$$H = \frac{\frac{nI_p}{2} - H_F \cdot l_F}{l_M} \ (AT/m).$$

On the other hand, the magnetic flux density $B_M$ in the permanent magnet 5 is $$B_M = \mu H = \frac{\mu \cdot \left(\frac{nI_p}{2} - H_F \cdot l_F\right)}{l_M}.$$

Given that mean magnetic flux density in the air-gap portion inclusive of the magnet is $B_G$, $$B_B \cdot S_G = B_F \cdot S_F$$

holds.

As will be described later, since in the iron core and permanent magnet of the ignition coil of this invention $S_G \approx S_M$ is preferably chosen, $B_B \approx B_M$ is held and the immediately above equation is reduced to $B \cdot S_G = B_F \cdot S_F$. By combining this equation with the above equation indicative of $B_M$, there results $$B_M = \frac{B_F \cdot S_F}{S_G} = \frac{\mu \cdot \left(\frac{nI_p}{2} - H_F \cdot l_F\right)}{l_M}$$

Consequently, the thickness $l_M$ is indicated by $$l_M = \frac{S_G}{S_F} \cdot \frac{\mu \cdot \left(\frac{nI_p}{2} - H_F \cdot l_F\right)}{B_F}$$

which is reduced to $$\frac{S_G}{S_F} = \frac{2 \cdot B_F \cdot l_M}{\mu(nI_p - 2H_F \cdot l_F)} \quad (1)$$

indicative of the cross-sectional area ratio $S_G/S_F$.

In the ignition coil of this invention, within the negative flux region of the hatched region in the performance characteristic curve diagram of FIG. 3, the iron core 12 is required to be magnetized by a magnetizing force of the primary coil in opposition to energy possessed by the magnet, so that positive flux may pass through the iron core. Therefore, where the iron core is first magnetized to the point C near the saturation point in the negative flux region of the iron core depicted in the lower left region in FIG. 3 by the action of a magnetizing force of the permanent magnet as described previously, and thereafter the iron core is magnetized to the point T near the saturation point in the positive flux region depicted upper right region in FIG. 3 by the action of a magnetizing force $nI_p$ due to the exciting current $I_p$ conducted through the primary coil, the maximum energy $E_M$ of the permanent magnet, which depends on the material and shape of the permanent magnet, is related to the energy W in FIG. 3, which is stored in the primary coil, by $E_M = \frac{1}{2} \cdot W$.

The area indicative of W in FIG. 3 is $$W = \tfrac{1}{2} \cdot (2 \cdot B_F \cdot S_F) \cdot nI_p = B_F \cdot S_F \cdot nI_p.$$

On the other hand, since the maximum energy product of a permanent magnet is expressed as $(B \cdot H)_{MAX}$, the theoretical value of the maximum energy $E_M$ possessed by the permanent magnet is indicated by $E_M = (B \cdot H)_{MAX} \cdot (S_M \cdot l_m)$. In the ignition coil of this invention, as an operating point of the permanent magnet to be determined by the gradient of the magnetization curve b of the permanent magnet shown in FIG. 4, an operating point is chosen to provide the maximum energy product $(B \cdot H)_{MAX}$ or to be positioned at least in the vicinity of such an optimum operating point.

Thus, the energy stored in the primary coil is $$\begin{aligned} W &= B_F \cdot S_F \cdot nI_p \\ &= 2E_M \\ &= 2 \cdot (B \cdot H)_{MAX} \cdot (S_M \cdot l_M) \end{aligned}$$

and from the above equation, the following equation indicative of the cross-sectional area ratio $S_M/S_F$ is obtained:

$$\frac{S_M}{S_F} = \frac{B_F \cdot nI_p}{2 \cdot (B \cdot H)_{MAX} \cdot l_M} \quad (2)$$

The above two equations (1) and (2) indicate the relationship between dimensions of individual portions of the magnetic circuit which should be chosen for the sake of making the most of the energy of the permanent magnet in the ignition coil of this invention.

A specific example of the ignition coil of this invention is constructed and tested to obtain performance results as will be described below. In the specific example, values of elements in equations (1) and (2) are selected as follows.

The permanent magnet 5 is made of $SmCo_5$ and values of elements therefor are:

$$(BH)_{MAX} = 20\ MGOe$$
$$\mu = 1.05$$

The iron core is formed of non-orientated silicon steel plates and values of elements therefor as:

$$S_F = 49\ mm^2,\ B_F = 1.4\ Wb/m^2,$$
$$nI_p = 800\ AT,\ H_F = 150\ AT/m,$$
$$l_F = 0.1\ m.$$

Figure 5:
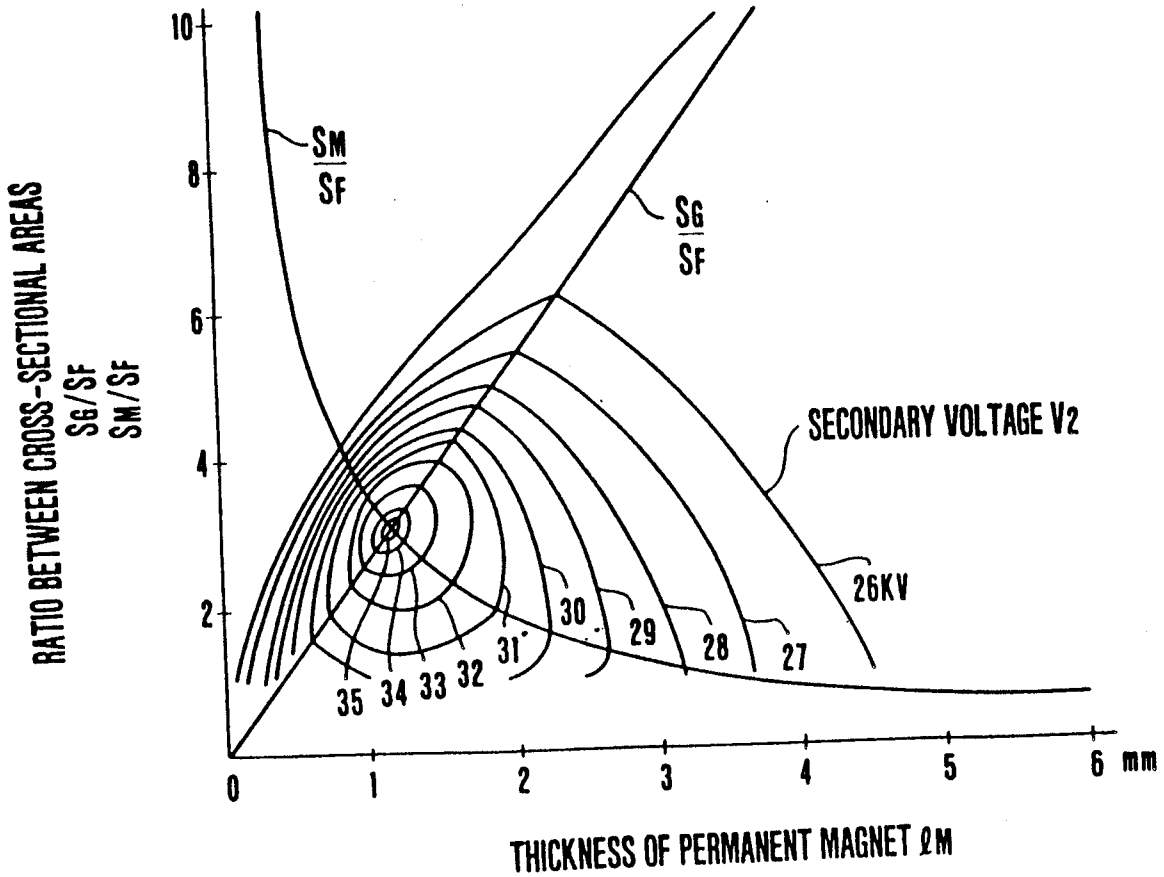
FIGS. 5 and 6 are characteristic diagrams showing the relation of the cross-sectional area ratios $S_G/S_F$ and $S_M/S_F$ and the voltage $V_2$ generated by the secondary coil versus the thickness $l_M$ of the permanent magnet, in which FIG. 6 especially shows the relation of the secondary voltage $V_2$ versus the thickness $l_M$ of the permanent magnet.
Figure 6:
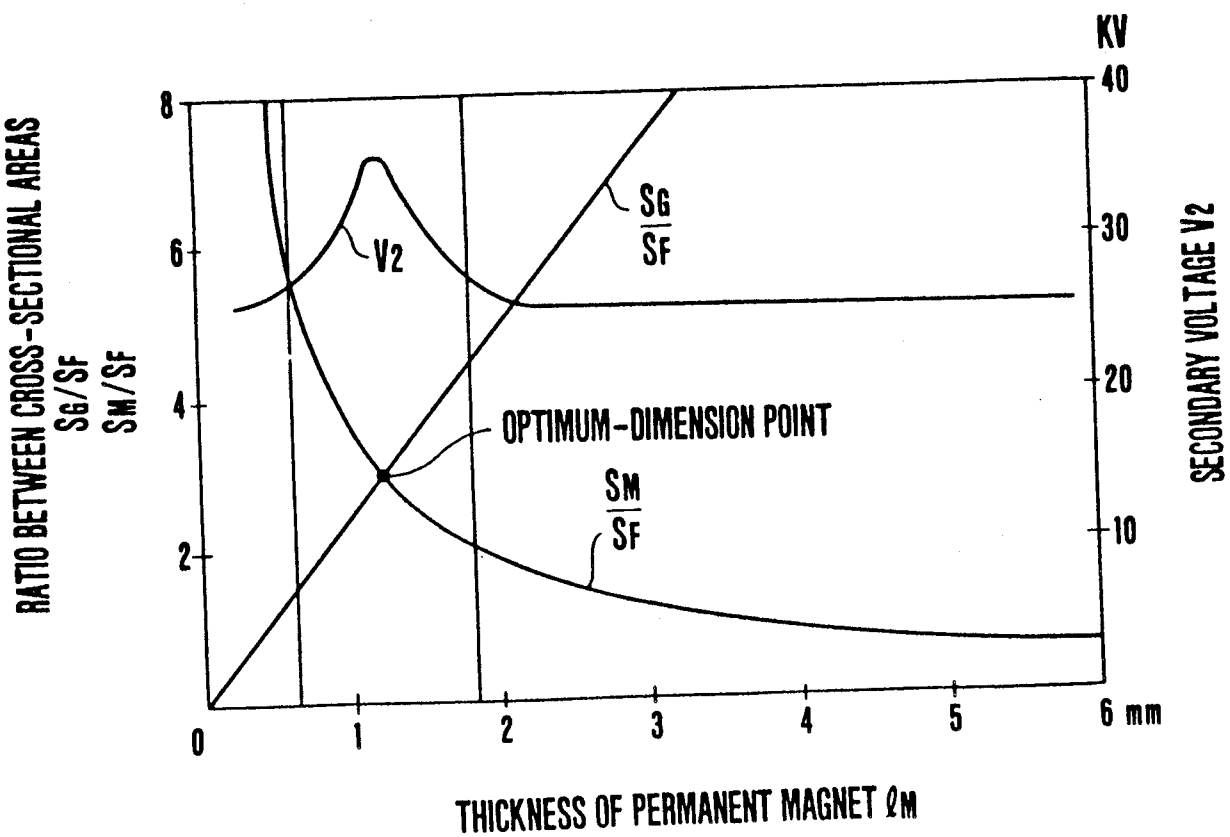

The values of the elements are substituted into the equations (1) and (2) to obtain the relation between the thickness $l_M$ M and each of the cross-sectional area ratios $S_G/S_F$ and $S_M/S_F$ as graphically shown in FIGS. 5 and 6. Also illustrated in FIGS. 5 and 6. Reference numeral 28 designates an optimum dimension point in FIG. 6 are values of the voltage $V_2$ generated in the secondary coil which are obtained from performance tests conducted with various ignition coils which differ in dimension of individual portions as the thickness $l_M$ is changed. Particularly, in FIG. 6, distribution curves of the secondary voltage $V_2$ shown in FIG. 5 are converted into a two-dimensional characteristic curve for better understanding of the relation between the thickness $l_M$ of the permanent magnet and the magnitude of the secondary voltage $V_2$.

As a result of the thus obtained data illustrated in FIGS. 5 and 6, optimum dimensional conditions for the ignition coil of this invention are as follows:

(a) $S_G \approx S_M$ should hold. That is, the cross-sectional area of the permanent magnet supporting portion of the iron core should be substantially equal to the cross-sectional area of the permanent magnet; and (b) The values of $l_M$, $S_M/S_F$ and $S_G/S_F$ should be within the following ranges in order to produce a very high secondary voltage $V_2$:

$$0.6 \text{ mm} < l_m < 1.8 \text{ mm}$$

$$2 < S_M/S_F < 6$$

$$1.5 < S_G/S_F < 4.5$$

After completion of the performance test, the ignition coils of this invention are checked for their characteristics to find that the characteristics of the used permanent magnets remain unchanged before and after the performance test, thus indicating clearly that the ignition coil of this invention is durable in continuous use, while maintaining desired performance.

The ignition coil of this invention so constructed as to meet the optimum dimensional conditions is compared with the conventional ignition coil in point of specific structural dimensions as will be described below.

Figure 7A:
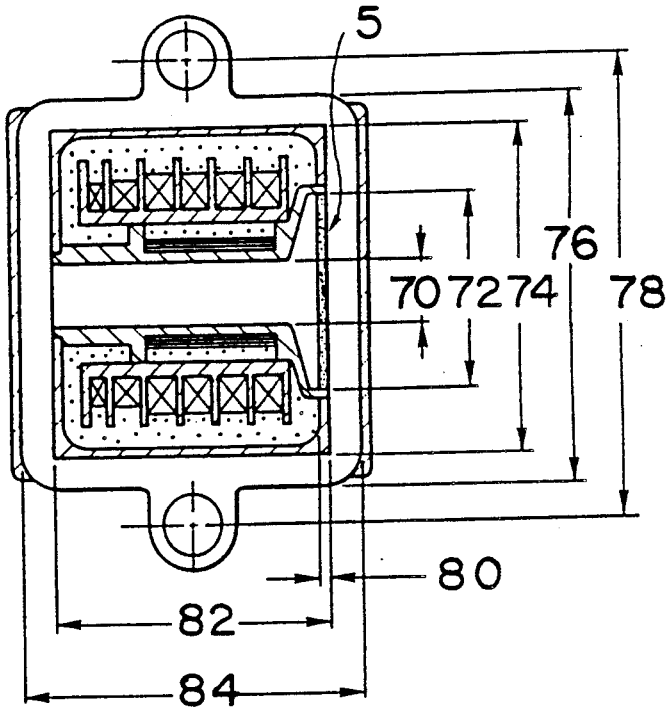
FIGS. 7 and 8 are sectional drawings for making a comparison between the ignition coil of this invention shown in FIG. 7 and the conventional ignition coil shown in FIG. 8.
Figure 7B:
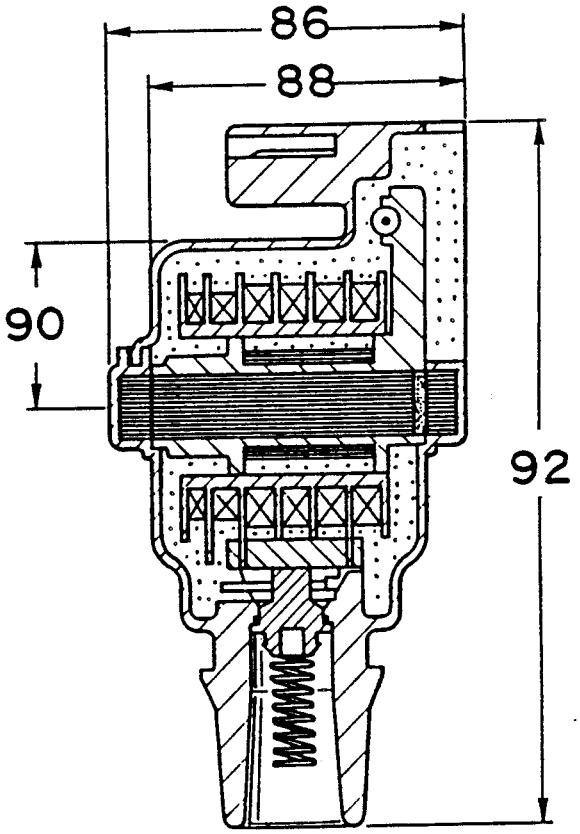
Figure 8A:
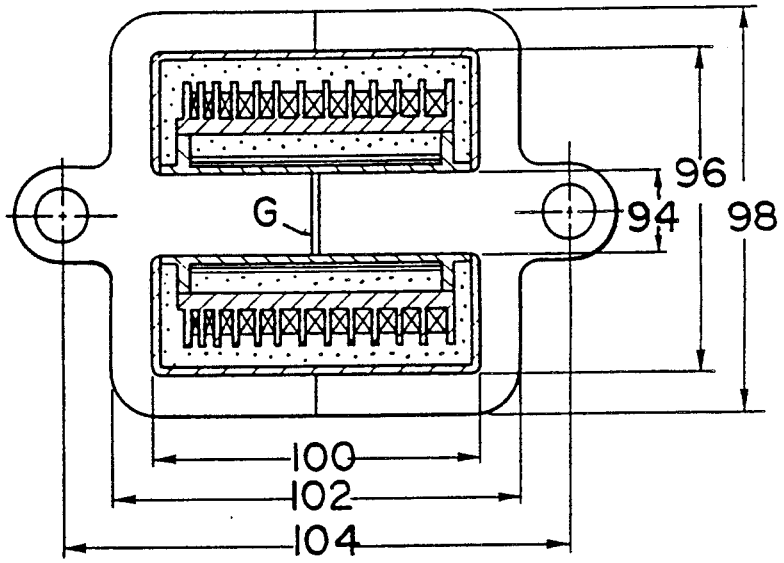
Figure 8B:
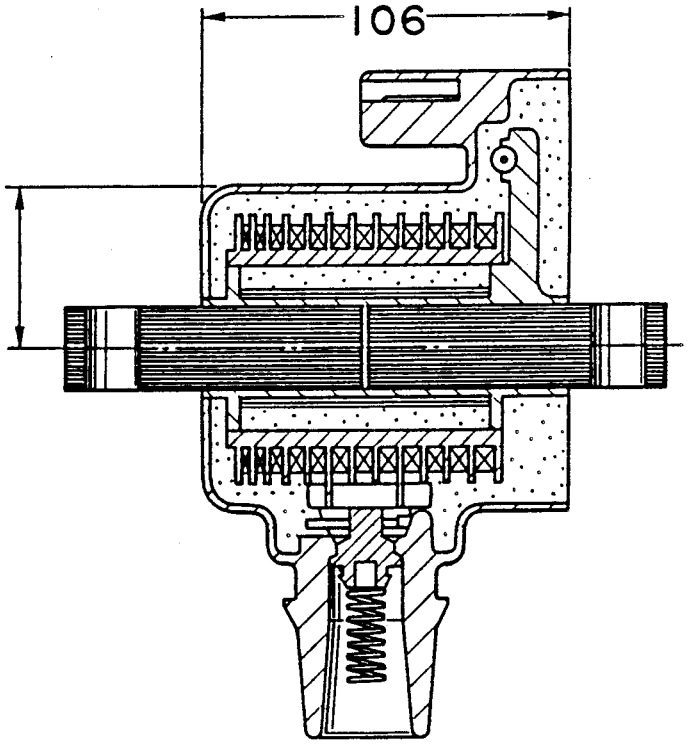

Under the condition that both the ignition coil of this invention and the conventional ignition coil are constructed to possess the same performance by having the same resistance value and the same number of turns of windings, and hence the same ampere-turn value, and, as a result, generating a secondary voltage of the same magnitude, both ignition coils were constructed to have dimensions such as shown in FIGS. 7 and 8, respectively.

The following comparison table shows dimensional factors along with performance values of the ignition coil of the present invention and the conventional ignition coil shown in FIGS. 7 and 8, respectively.

In FIG. *7a*, reference numeral 70 denotes a dimension of 7 millimeters (mm); reference numeral 72 denotes a dimension of 21 mm; reference numeral 74 denotes a dimension of 36 mm; reference numeral 76 denotes a dimension of 43 mm; and reference numeral 78 denotes a dimension of 51 mm. Also, reference numeral 80 denotes a dimension of 1.2 mm; reference numeral 82 denotes a dimension of 30 mm; and reference numeral 84 denotes a dimension of 37 mm.

In FIG. *7b*, reference numeral 86 denotes a dimension of 39 millimeters (mm); reference numeral 88 denotes a dimension of 34.5 mm; reference numeral 90 denotes a dimension of 18 mm; and reference numeral 92 denotes a dimension of 75.9 mm.

In FIg. *8a*, reference numeral 94 denotes a dimension of 10 mm; reference numeral 96 denotes a dimension of 40 mm; reference numeral 98 denotes a dimension of 50 mm; reference numeral 100 denotes a dimension of 39.5 mm; reference numeral 102 denotes a dimension of 49.5 mm; and reference numeral 104 denotes a dimension of 61.5 mm.

In FIG. *8b*, reference numeral 106 denotes a dimension of 44.5 and reference numeral 108 denotes a dimension of 20 mm.

| | | Kind of ignition coil | |
|---|---|---|---|
| No. | Component factors and functions | Ignition coil of this invention (FIG. 7) | Conventional ignition coil (FIG. 8) |
| 1 | primary coil | 0.37ϕ × 133 T (0.84Ω) | 0.42ϕ × 133 T (0.9Ω) |
| 2 | outer diameter of primary coil | 36 mm | 48 mm |
| 3 | secondary coil | 0.05ϕ × 13,300 T. | 0.05ϕ × 13,300 T |
| 4 | total winding space (total volume inclusive of insulating portion) | 30 $cm^3$ | 52 $cm^3$ |
| 5 | primary AT ($nI_p$) | 800 AT (primary current of 6A × 133 T) | 800 AT (primary current of 6A × 133 T) |
| 6 | secondary voltage ($V_2$) | 36 KV (at primary current of 6A) | 36 KV (at primary current of 6A) |
| 7 | cross-sectional area of exciting part iron core ($S_F$) | 49 $mm^2$ (7 mm square) | 100 $mm^2$ (10 mm square) |
| 8 | cross-sectional area of permanent magnet supporting portion of iron core ($S_G$) | 21 mm × 7 mm (147 $mm^2$) | — |
| 9 | mean magnetic path length ($l_F$) | 106.5 mm | 134 mm |
| 10 | weight of iron core | 40 g | 115 g |
| 11 | length of air gap (G) | — | 0.8 mm |
| 12 | thickness of permanent magnet ($l_M$) | 1.2 mm | — |
| 13 | cross-sectional are of permanent magnet ($S_M$) | 21 mm × 7 mm (147 $mm^2$) | — |
| 14 | total weight of finished product | 130 g | 280 g |

By comparing, in the structural dimensions, the ignition coil of this invention and the conventional ignition coil which are both constructed to attain the same performance, it can be seen that as compared to the conventional ignition coil, the ignition coil of this invention is greatly reduced to about ½ in the cross-sectional area $S_F$ of the exciting part iron core, consequently reduced to about $1/\sqrt{2}$ in the contour length of the exciting part iron core, consequently reduced to about ⅓ in weight of the iron core and reduced to about ½ in the total wiring space. As a result, the total weight of a finished product can be reduced to ½ or less, demonstrating that, when compared with the conventional ignition coil, the ignition coil of this invention can be reduced drastically in size and weight.

The construction of the iron core used in the ignition coil of this invention shown in FIG. 7 may be improved as will be described below.

Figure 9A:
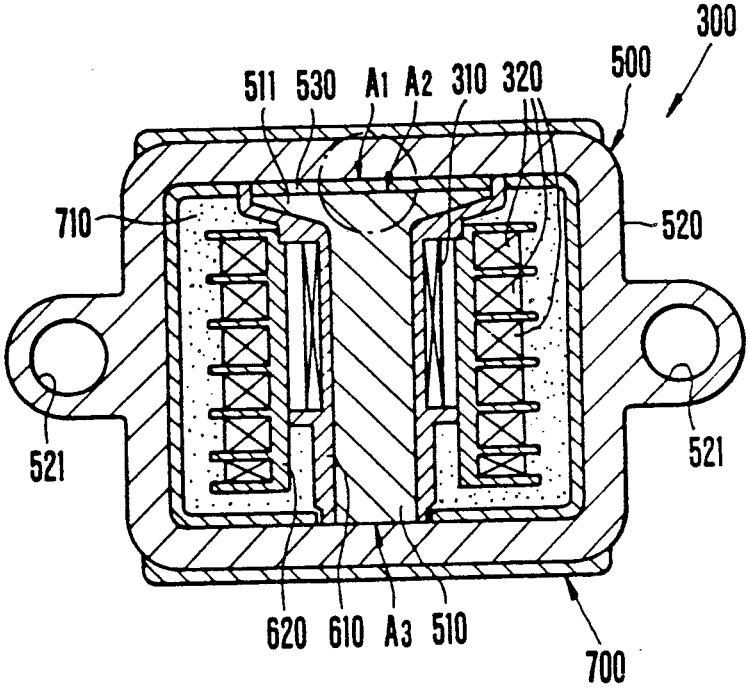
FIG. 9 is an enlarged sectional drawing showing details of the ignition coil of the present invention similar to that shown in FIG. 7.
Figure 9B:
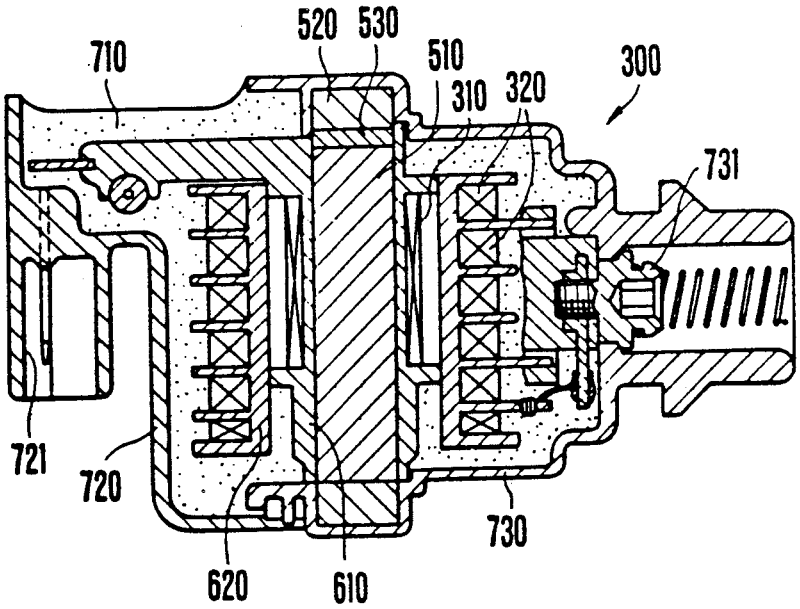

More particularly, an improved portion of an ignition coil 300 of this invention having a structure similar to the ignition coil shown in FIG. 7 is illustrated in the enlarged sectional drawing of FIG. 9 to give better understanding of the improved portion.

Referring to FIG. 9, an iron core 500 includes an exciting part iron core 510 and an outer closed magnetic circuit forming part iron core (simply referred to as outer part iron core) 520. The exciting part iron core 510 is constructed by laminating lamina made of a grain-oriented magnetic material and punched into a T-shape form and caulking the lamination. One end of the exciting part iron core has the form of a head 511 having a wide-width and flat end surface. Like the exciting part iron core 510, the outer part iron core 520 is constructed by laminating lamina made of a similar grain-oriented magnetic material and punched into a □-shape form and caulking the lamination. The lamination, united together by caulking, provides a □-shaped robust annular portion. Denoted by 521 are ring portions for installing the ignition coil 300.

Figure 10:
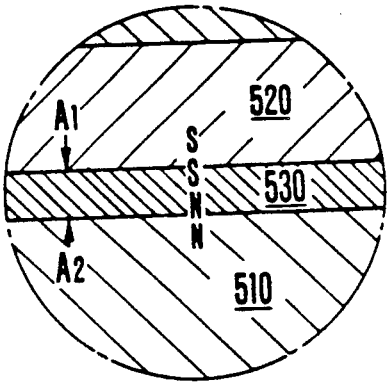
FIG. 10 is an enlarged fragmentary sectional drawing showing the permanent magnet inserted between the end surface of the head of the exciting part iron core and an opposite inner surface of the outer closed magnetic circuit forming part iron core (hereinafter simply referred to as an outer part iron core).

In an air-gap portion $A_1$–$A_2$ between the end surface $A_2$ of the head 511 of the exciting part iron core 510 and an inner opposite surface $A_1$ of the outer part iron core 520, a permanent magnet 530, made of a strong permanent magnet material as described previously, is disposed such that, as shown in an enlarged from in FIG. 10, the magnetic flux of the permanent magnet opposes the magnetic flux generated by the exciting part iron core 510 in the air-gap portion when the exciting part iron core 510 is excited, that is, adjoining surfaces of the exciting part iron core 510 and permanent magnet 530 have the same polarity (N in FIG. 10) and adjoining surfaces of the outer part iron core 520 and permanent magnet 530 have the same polarity (S in FIG. 10).

Returning again to FIG. 9, the size of the permanent magnet 530 is chosen to sufficiently cover the entire end surface $A_2$ of the head 511 of the exciting part iron core 510. The opposite end $A_3$ of the exciting part iron core 510 abuts against an opposite inner surface of the outer part iron core 520.

An inner bobbin 610 and an outer bobbin 620 are disposed concentrically with the exciting part iron core 510, and a primary coil 310 is wound around the inner bobbin 610 and a secondary coil 320 is wound around the outer bobbin 620.

An ignition coil case 700 includes a first case 720 and a second case 730. Potting resin 710 is potted in the ignition coil case 700 and cured therein.

The FIG. 9 ignition coil of this invention is structurally improved in the following points.

Firstly, with the permanent magnet 530 inserted in the air-gap portion $A_1$–$A_2$ between the exciting part iron core 510 and the outer part iron core 520 as shown in FIG. 9, the magnetic flux generated in the exciting part iron core 510 by the energization of the primary coil 310 repulses the magnetic flux generated by the permanent magnet 530, and consequently, as will be seen from FIG. 10, a repulsive force takes place between the permanent magnet 530 and the exciting part iron core 510 and between the permanent magnet 530 and the outer part iron core 520, thus forcing each of the exciting part iron core 510 and the outer part iron core 520 to depart from each other. However, the outer part iron core 520 of the firm annular monobloc structure ca withstand the repulsive force generated across the air-gap portion $A_1$–$A_2$, thereby being free from any deformation thereof. This eliminates a necessity of additional provision of any special reinforcement member for preventing the deformation of the outer part iron core 520.

Figure 11:
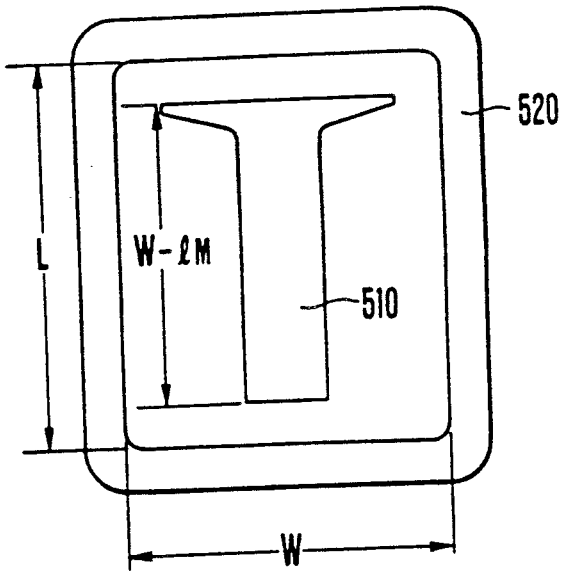
FIG. 11 is a layout diagram for illustrating a layout design of a magnetic material thin plate for forming an outer part iron core sheet steel and an exciting part iron core sheet steel when the magnetic material thin plate is punched simultaneously.

Referring to FIG. 11, reference numeral 30 designates the inner dimension L of the outer part iron core 520, reference numeral 32 designates the width W of the core 520, and 34 designates the length of the exciting part iron core, which satisfies the condition $W\text{-}l_M$. A punching layout shown therein may be advantageously adopted, in which the inner dimension L of the outer part iron core 520 having the shape shown in FIG. 9 is designed to satisfy the relation $W<L$. It is because, when punching a thin plate made of a magnetic material to obtain a punched sheet steel for the outer part iron core 520, a part of the magnetic material thin plate inside the part thereof to be used to obtain the punched sheet steel for the outer part iron core 520 can be utilized to be punched at the same time to thereby obtain a punched sheet steel for the exciting part iron core 510 having a height of $W\text{-}l_M$. In this manner, the procedure of obtaining a punched sheet steel for forming the iron core 500 can be simplified and the production yield of the iron core 500 can be improved.

Figure 12:
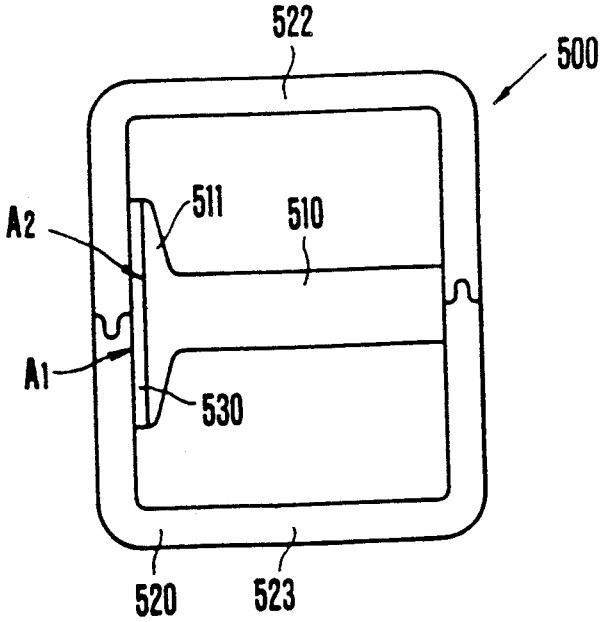
FIG. 12 is a plan view showing an iron core for use in the ignition coil of another embodiment of this invention including an outer part iron core formed by jointing together two split iron cores.

FIG. 12 shows another embodiment of the iron core according to the present invention for use in an ignition coil which is particularly directed to a construction of the outer part iron core 520. In this embodiment, two split iron cores 522 and 523 are formed by punching a thin plate of a magnetic material such as mentioned above to have a ⊐-shaped form, laminating the punched steel sheets and caulking the resultant lamination. The two ⊐-shaped split iron cores 522 and 523 are butt-jointed together at their respective ends which are positioned on the longitudinal axis line of the exciting part iron core 510 and the butt-jointed portions are consolidated by a suitable jointing process such as a driving fit process, welding process, etc. The outer part iron core of this embodiment can attain the same effects as the □-shaped outer part iron core 520 shown in FIG. 9.

The permanent magnet 530, exciting part iron core 510 and outer part iron core 520 which are used in the ignition coil of this invention shown in FIG. 9 are produced with dimensional tolerance as usual and when they are put together, small gaps inevitably occur at junction portions between the permanent magnet 530 and each of the exciting part iron core 510 and outer part iron core 520, and between the exciting part iron core 510 and the outer part iron core 520. Under the circumstance, in order to improve the magnetoelectric conversion performance of the ignition coil of this invention, an increase in reluctance of the magnetic circuit due to the small air gaps must be suppressed as much as possible.

With a view to accomplishing this task, in the ignition coil of this invention shown in FIG. 9, one end portion of the exciting part iron core 510 contiguous to the permanent magnet 530 is enlarged to satisfy $S_G > S_F$, as described previously in connection with FIGS. 5, 6 and 7, so that reluctance in air gaps at junction portions contiguous to the upper and lower surfaces of the permanent magnet 530 may be reduced.

Figure 13:
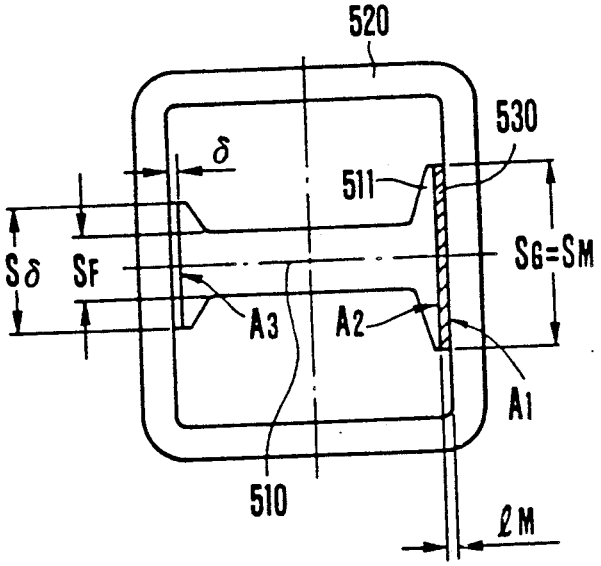
FIG. 13 is a plan view showing an iron core for use in the ignition coil of still another embodiment of this invention which includes an exciting part iron core whose junction portion with an opposite inner surface of the outer part iron core has an enlarged area.

FIG. 13 shows still another embodiment of the iron core for use in the ignition coil of this invention. This embodiment intends to make a further reduction in reluctance. Thus, in this embodiment, the width of the other end portion of the exciting part iron core 510 is enlarged into a T-shaped form having an end surface $A_3$ of an enlarged area $S_d$, whereby reluctance due to an air gap $\delta$ between the end surface $A_3$ of the exciting part iron core 510 and the inner surface of the outer part iron core 520 can be reduced to make the most of magnetic energy of the permanent magnet. In the embodiment shown in FIG. 13, the area of the junction portion between the other end surface of exciting part iron core 510 and the opposite inner surface of the outer part iron core 520 is increased by enlarging the width of the other end portion of the exciting part iron core 510 into the T-shaped form. Alternatively, in modifications as shown at sections (A) and (B) in FIG. 14, the same purpose can be accomplished by providing a junction surface 36 which is inclined with respect to the center axis of the exciting part iron core 510.

Figure 14A:
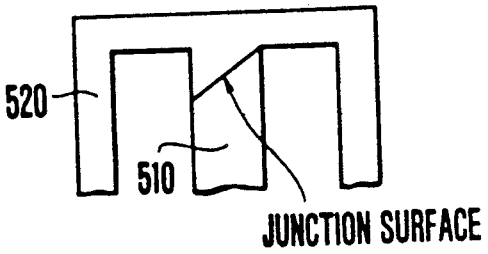
FIGS. 14(A) and (B) are respective fragmentary plan views showing modifications of an iron core of the ignition coil of the present invention having an enlarged junction area as shown in FIG. 13.
Figure 14B:
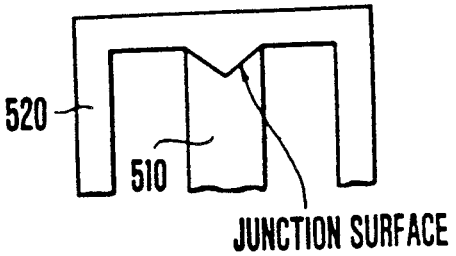

A described above, in the ignition coil shown in FIG. 9 in which the permanent magnet is inserted in a air-gap portion formed at a part of the iron core including the exciting part iron core and forming a closed magnetic path, a decrease in the efficiency of conversion of magnetic energy into a secondary coil electromotive force which is due to air-gap reluctance at the junction portions between the constituent iron cores and between the iron core and the permanent magnet can be prevented by increasing the area of the junction portions in accordance with the embodiment shown in FIG. 13 and the modification of the iron core shown in FIG. 14. In the iron core of a further embodiment of this invention described below, the appearance of air gaps per se at the unction portions is suppressed positively.

Figure 15A:
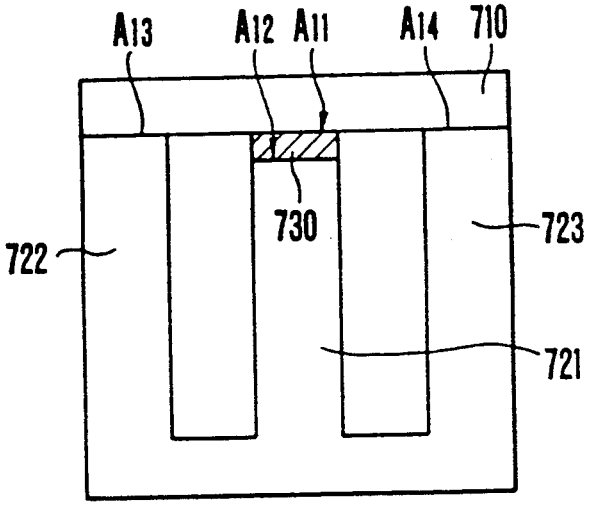
FIG.15(A) PRIOR ART
Figure 15B:
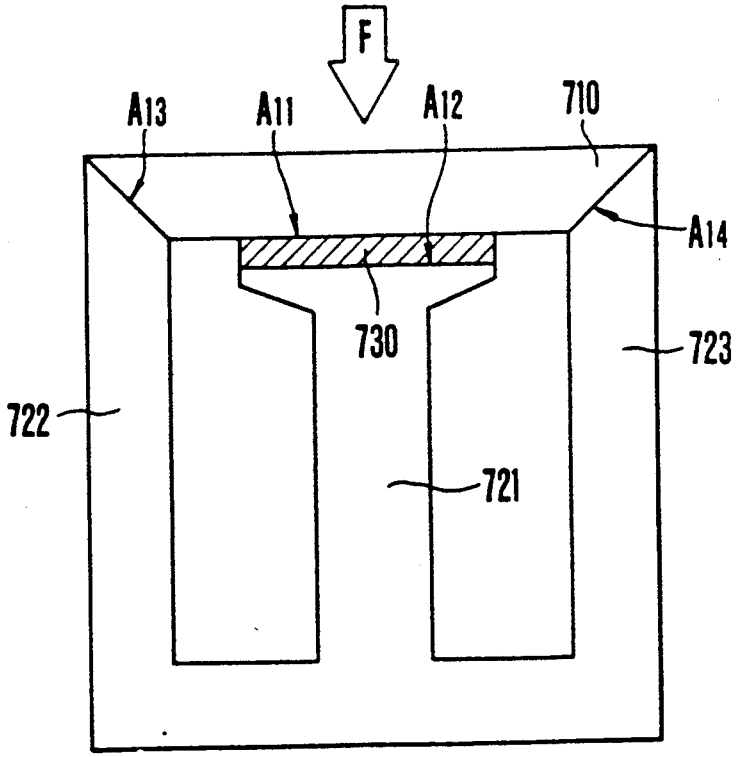
FIG. 15(B) shows an E–I type iron core for use in the ignition coil of a further embodiment of this invention.

Considering positive suppression of occurrence of air gaps per se, a known so-called E–I type core as shown in FIG. 15(A) may conveniently be employed, whereby an E-shaped part iron core and an I-shaped part iron core are jointed together, with a permanent magnet 730 inserted between the end surface $A_{12}$ of a central leg 721 of the E-shaped part iron core and the opposite surface $A_{11}$ of the I-shaped part iron core 710. In the known E–I type core, because of dispersion of dimensions of a finished E-shaped part iron core and an I-shaped part iron core and the thickness of the permanent magnet, sufficient flatness of junction surfaces $A_{11}$, $A_{12}$, $A_{13}$ and $A_{14}$ can not be obtained and avoidance of generation of air gaps at junction portions is difficult to achieve. To eliminate this disadvantage, in the iron core of the ignition coil of a further embodiment of this invention shown in FIG. 15(B), the end surfaces of both outer legs 722 and 723 of the E-shaped part iron core as well as the opposite end surfaces of the I-shaped part iron core 710, which face the end surfaces of the outer legs 722 and 723 of the E-shaped part iron core, are tapered with respect to the center axe of the legs of the E-shaped part iron core. With this construction, the position of the I-shaped part iron core 710 can be adjusted vertically. Then, the E-shaped part iron core and I-shaped part iron core are brought into contact with each other, with their inclined surfaces mating with each other, and, while applying an external force F as shown, junction portions at the inclined surfaces of the two part iron cores are robustly jointed together by welding, for example. In this manner, the occurrence of air gaps can be suppressed even in the presence of dispersion of dimensions of component parts, whereby a decrease in the magnetoelectric conversion performance of the ignition coil can be prevented to provide stable and excellent performance.

In the practical production of the ignition coil of this invention shown in FIG. 9, it is preferable that air gaps appearing at junction portions between the exciting part iron core 510 and the outer part iron core 520 and between the permanent magnet 530 and each of the exciting part iron core 510 and the outer part iron core 520 be located collectively at a single appropriate position.

Figure 16:
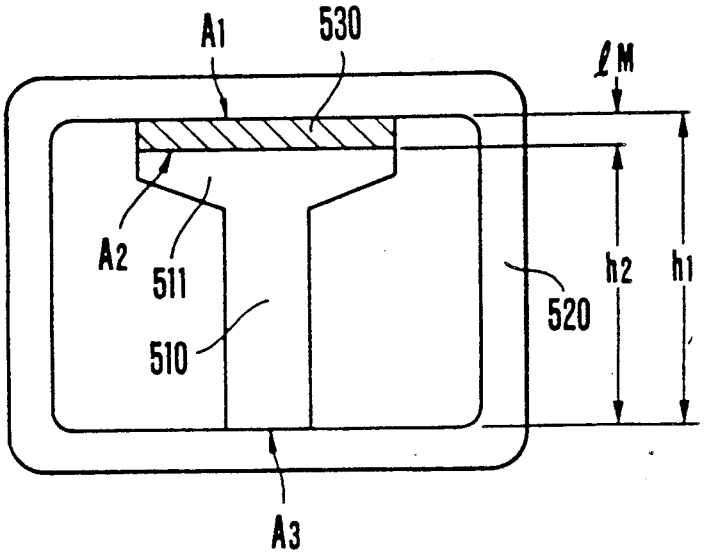
FIG. 16 is an explanatory drawing for explaining the appearance of air gaps at the junction portions of the iron core for use in the ignition coil of this invention shown in FIG. 9.

More particularly in the ignition coil of this invention having the iron core and permanent magnet arranged as shown in FIG. 9, the outer part iron core 520, exciting part iron core 510 and permanent magnet 530 are worked and finished independently as schematically shown in FIG. 16, and, because of dispersion of the inside dimension 38($h_1$) between the opposite inner surfaces of the outer part iron core 520, the overall length (height) 40 ($h_2$) of the exciting part iron core 510 and the thickness 24 ($l_M$) of the permanent magnet 530 as well as insufficient flatness of the junction surfaces $A_1$, $A_2$ and $A_3$ and upper and lower surfaces of the permanent magnet, air gaps take place inevitably at the junction portions.

In the past, assembling of this type of ignition coil was carried out without considering at which one of the junction portions contiguous to the three junction surfaces $A_1$, $A_2$ and $A_3$ inevitably occurring air gaps should be located, and therefore nonuniformity of the magnetoelectric conversion performance of the assembled ignition coil disadvantageously resulted.

Improvements in the ignition coil of this invention which are dedicated to elimination of the above disadvantage will be described with reference to FIG. 17. For better understanding of the improved portion, a part of the ignition coil of FIG. 9 is illustrated exaggeratedly in FIG. 17.

As a result of the tests conducted by the inventor, it was found that, when air gaps, which are caused by the foregoing fact and appear in the magnetic circuit of the ignition coil of this invention, are located collectively on any one of the upper and lower surfaces of the permanent magnet, the influence of the air gaps upon the performance of the ignition coil can be minimized, whereby degradation and dispersion of the ignition performance can be reduced. Therefore, in the ignition coil of this invention, the exciting part iron core 510 is made to abut an inner surface of the outer part iron cor 520 to be in close contact with the latter and the end surface of the head 511 of the exciting part iron core 510 is also brought into close contact with the lower surface of the permanent magnet 530 so that occurrence of air gaps at these junction portions may be prevented as far as possible, whereby air gaps inevitably appearing in the closed magnetic circuit are located collectively between the upper surface of the permanent magnet 530 and an opposite inner surface of the outer part iron core 520.

Figure 17:
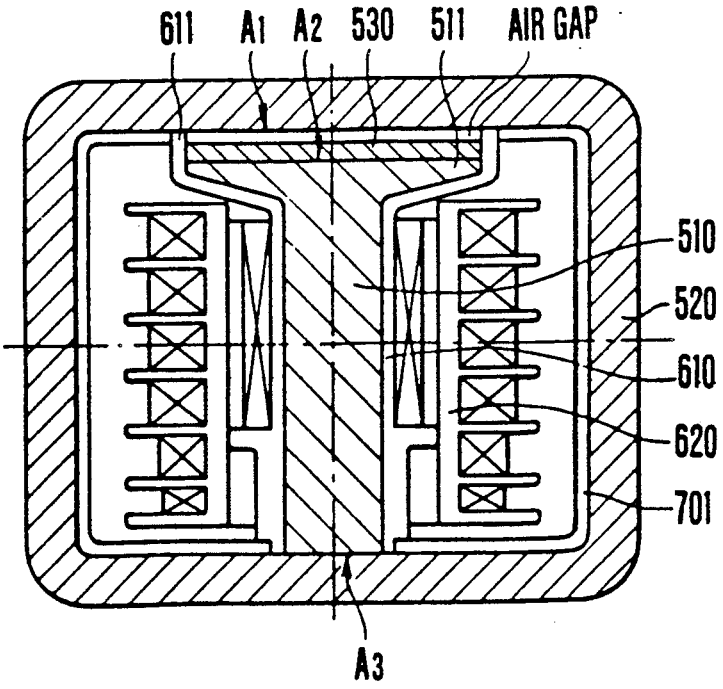
FIG. 17 is an enlarged sectional view showing an essential portion of the ignition coil shown in FIG. 9, which is used to explain a construction for restricting the location of occurrence of air gaps explained with reference to FIG. 16 to a desired position or positions in the magnetic circuit of the ignition coil.

FIG. 17 also shows a specific construction for realizing the localization of air gaps. More particularly, a inner coil case 701 is made of plastic and extends along the inner surface of the outer part iron core 520. The case 701 is integral with the outer part iron core 520. An inner bobbin 610 made of plastic surrounds the exciting part iron core 510 and is integral therewith. An outer bobbin 620 also made of plastic is fixed to surround the inner bobbin 610. The upper open end of the inner bobbin 610 is expanded and is provided with a projecting circumferential edge 611, which is press fitted into the upper opening of the inner coil case 701. Reaction force resulting from the press fitting of the tip of the projecting circumferential edge 611 of the inner bobbin 610 into the opening of the inner coil case 701 brings the bottom surface $A_3$ of the exciting part iron core 510 into close contact with the lower inner surface of the outer part iron core 520, ensuring that, during assembling, air gaps 42 occurring in the ignition coil can be located collectively between the upper surface of the permanent magnet 530 and the upper inner surface $A_1$ of the outer part iron core 520.

As is clear from the foregoing description, according to this invention, the magnetic circuit of the ignition coil can be realized which includes the iron core and permanent magnet having a shape and dimension suitable for the purpose of making the most of the strong permanent magnet inserted in the magnetic circuit, and as a result, the ignition coil of this invention can be reduced drastically in size and weight as compared with a conventional ignition coil of the same performance.

The magnetic circuit of the ignition coil can be improved further to assure excellent magnetoelectric conversion performance of the ignition coil.

I claim:

1. An ignition coil comprising an iron core forming a closed magnetic circuit through an air-gap portion provided at a portion of said iron core, a primary coil wound around an exciting part iron core of said iron core for exciting said iron core upon energization thereof, a secondary coil wound around said primary coil concentrically, and a permanent magnet inserted in said air-gap portion of said iron core, the direction of magnetization of which is opposite to the direction of magnetization of said iron core to be caused by the energization of said primary coil, characterized in that said ignition coil is constructed to satisfy the following conditions:

$$0.6 \text{ mm} < l_m < 1.8 \text{ mm}$$

$$2 < S_M/S_F < 6$$

$$1.5 < S_G/S_F < 4.5$$

where $l_M$ is the thickness of said permanent magnet, $S_M$ is the cross-sectional area of said permanent magnet, $S_F$ is the cross-sectional area of said exciting part iron core of said iron core and $S_G$ is the cross-sectional area of a permanent magnet supporting portion of said iron core.

2. An ignition coil according to claim 1, wherein a permanent magnet, whose permeability u satsifies the condition $\mu \approx 1$, is selected as said permanent magnet.

3. An ignition coil according to claim 1, wherein said iron core comprises a □-shaped outer closed magnetic circuit forming part iron core abbreviated as an outer part iron core, and said exciting part iron core disposed inside of said outer part iron core and having first and second end surfaces arranged to be opposite to first and second inner surfaces of said outer part iron core, respectively, and said permanent magnet is interposed between the first end surface of said exciting part iron core and the first inner surface of said outer part iron core.

4. An ignition coil according to claim 3, wherein said outer part iron core is composed of two similar ⊐-shaped split iron cores whose respective ends are butt-jointed together and the butt-jointed portions are consolidated.

5. An ignition coil according to claim 3, wherein the second end surface of said exciting part iron core is brought into close contact with the second inner surface of said outer part iron core so that air gaps appearing in the closed magnetic circuit of said ignition coil may be collectively located substantially at least at one of two junction portions between said permanent magnet and the first inner surface of said outer part iron core and between said permanent magnet and the first end surface of said exciting part iron core.

6. An ignition coil according to claim 5, wherein, in order to increase a junction contact area of the junction portion between the second end surface of said exciting part iron core and the second inner surface of said outer part iron core, an end portion on the second end surface side of said exciting part iron core is made to have a contour dimension greater than that of any other axially intermediate portion of said exciting part iron core.

7. An ignition coil according to claim 5, wherein in order to increase a junction contact area of the junction portion between the second end surface of said exciting part iron core and the second inner surface of said outer part iron core, the second end surface of said exciting part iron core is formed to have at least one inclined surface, which makes an inclination angle with the longitudinal axis of said exciting part iron core, and the second inner surface of said outer part iron core opposite to the second end surface of said exciting part iron core is formed to have at least one mating inclined surface having the same inclination angle as that of said at least one inclined surface of said exciting part iron core, said at least one inclined surface of said exciting part iron core being in close butt-engagement with said at least one mating inclined surface of said outer part iron core.

8. An ignition coil according to claim 1, wherein said iron core comprises an E-shaped iron core having three legs including a central leg and outer legs and a I-shaped iron core having a side surface which mates with respective end surfaces of the three legs of said E-shaped iron core to form a closed magnetic circuit, the central leg of said E-shaped iron core is constructed to act as said exciting part iron core, said permanent magnet is inserted between an end surface of the central leg of said E-shaped iron core and an intermediate portion of the side surface of said I-shaped iron core, and respective end portions of the side surface of said I-shaped iron core and respective opposite end portions of the outer legs of said E-shaped iron core are provided with respective opposite inclined surfaces which are arranged to mate with each other, whereby said iron core is assembled by applying a force in the direction of the longitudinal axes of the three legs of said E-shaped iron core so as to press said I-shaped iron core against said E-shaped iron core, while firmly butt-jointing the inclined surfaces at the respective end portions of the side surface of said I-shaped iron core and the opposite inclined surfaces at the respective opposite end portions of the outer legs of said E-shaped iron core with each other, thereby preventing air gaps from appearing in the closed magnetic circuit of said ignition coil.

* * * * *